US010712762B2

(12) United States Patent
Kim et al.

(10) Patent No.: US 10,712,762 B2
(45) Date of Patent: Jul. 14, 2020

(54) SEMICONDUCTOR CIRCUIT AND SEMICONDUCTOR SYSTEM

(71) Applicant: SAMSUNG ELECTRONICS CO., LTD., Suwon-si, Gyeonggi-do (KR)

(72) Inventors: Joo Seong Kim, Seoul (KR); Kwang Ho Kim, Yongin-si (KR); Sang Ho Kim, Suwon-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 16/447,259

(22) Filed: Jun. 20, 2019

(65) Prior Publication Data

US 2020/0019203 A1 Jan. 16, 2020

(30) Foreign Application Priority Data

Jul. 16, 2018 (KR) ..... 10-2018-0082161

(51) Int. Cl.
*G05F 3/26* (2006.01)

(52) U.S. Cl.
CPC ..... *G05F 3/265* (2013.01)

(58) Field of Classification Search
CPC ..... G05F 3/20–30
See application file for complete search history.

(56) References Cited

U.S. PATENT DOCUMENTS

| | | | | |
|---|---|---|---|---|
| 5,610,506 | A | 3/1997 | McIntyre | |
| 5,867,013 | A | 2/1999 | Yu | |
| 6,060,918 | A | 5/2000 | Tsuchida et al. | |
| 6,509,726 | B1 | 1/2003 | Roh | |
| 6,784,652 | B1 | 8/2004 | Aude | |
| 7,208,929 | B1 | 4/2007 | Rabeyrin et al. | |
| 7,259,543 | B2 | 8/2007 | Chih | |
| 7,531,999 | B2 | 5/2009 | Chang | |
| 7,768,343 | B1 | 8/2010 | Sinitsky | |
| 8,283,974 | B2 | 10/2012 | Chu et al. | |
| 8,294,449 | B2 | 10/2012 | Ide | |
| 9,030,186 | B2 | 5/2015 | Gupta et al. | |
| 9,229,467 | B2 | 1/2016 | Li | |
| 2017/0012609 | A1* | 1/2017 | Shen | G05F 3/267 |
| 2017/0277210 | A1 | 9/2017 | Nilson | |

* cited by examiner

*Primary Examiner* — Fred E Finch, III
*Assistant Examiner* — Rafael O. De León Domenech
(74) *Attorney, Agent, or Firm* — Lee IP Law, P.C.

(57) ABSTRACT

Provided are a semiconductor circuit and a semiconductor system. A semiconductor circuit includes a bandgap reference voltage generation circuit including an operational amplifier to amplify a differential voltage between a first node and a second node; a first startup circuit which receives input of an output signal of the operational amplifier from an output voltage node of the bandgap reference voltage generation circuit and pulls up the second node; and a second startup circuit which pulls down the output voltage node.

17 Claims, 6 Drawing Sheets

SEMICONDUCTOR CIRCUIT AND SEMICONDUCTOR SYSTEM

CROSS-REFERENCE TO RELATED APPLICATIONS

Korean Patent Application No. 10-2018-0082161, filed on Jul. 16, 2018, in the Korean Intellectual Property Office, and entitled: "Semiconductor Circuit and Semiconductor System," is incorporated by reference herein in its entirety.

BACKGROUND

1. Field

The present disclosure relates to a semiconductor circuit and a semiconductor system.

2. Description of the Related Art

A bandgap reference voltage generation circuit generates constant and stable bandgap reference voltage and supplies the voltage to an electrical element. The bandgap reference voltage generation circuit may be integrated with other electrical elements in an integrated circuit (IC). In general, the bandgap reference voltage generation circuit receives a startup power supply at the beginning of driving. To this end, a startup circuit connected to a specific node of the bandgap reference voltage generation circuit to perform the startup may be implemented together.

The startup circuit for the bandgap reference voltage generation circuit may be implemented in various types, e.g., a pull-down type. For example, in order to smoothly perform the startup in the bandgap reference voltage generation circuit implemented using an operational (OP) amplifier, a voltage level difference between two input terminals of the OP amplifier needs to be sufficiently large. To this end, a particular node associated with one input terminal of the OP amplifier may be pulled down.

SUMMARY

According to an aspect of the present disclosure, there is provided a semiconductor circuit including a bandgap reference voltage generation circuit including an OP amplifier to amplify a differential voltage between a first node and a second node; a first startup circuit which receives input of an output signal of the OP amplifier from an output voltage node of the bandgap reference voltage generation circuit and pulls up the second node; and a second startup circuit which pulls down the output voltage node.

According to another aspect of the present disclosure, there is provided a semiconductor circuit including a bandgap reference voltage generation circuit which includes an OP amplifier to amplify a differential voltage between a first node and a second node; a first startup circuit which includes a first transistor controlled by a voltage level of a startup node to provide a power supply voltage to the second node, and a second transistor controlled by a voltage level of an output voltage node of the bandgap reference voltage generation circuit to provide the power supply voltage to the startup node; and a second startup circuit which includes a third transistor controlled by an inverted voltage level of the startup node to provide a ground voltage to the output voltage node.

According to still another aspect of the present disclosure, there is provided a semiconductor system including a bandgap reference voltage generation circuit including an OP amplifier to amplify a differential voltage between a first node and a second node; a first startup circuit which receives input of an output signal of the OP amplifier from an output voltage node of the bandgap reference voltage generation circuit and pulls up the second node; a second startup circuit which pulls down the output voltage node; and one or more Intellectual Property blocks which is driven using a voltage provided through the output voltage node.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
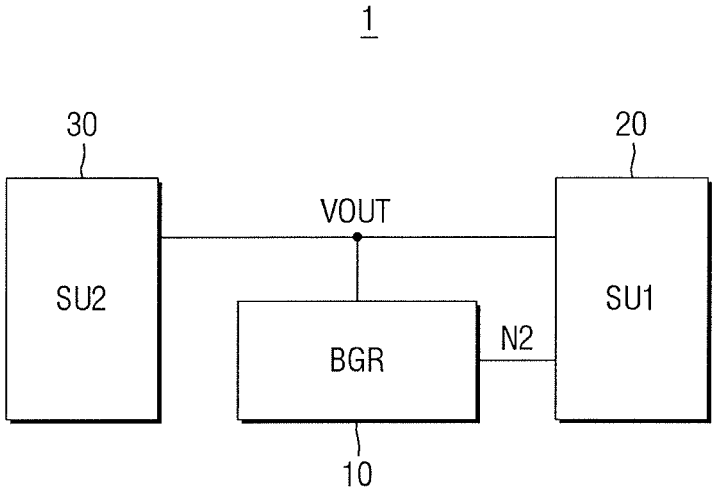
FIG. 1 illustrates a conceptual diagram for describing a semiconductor circuit according to an embodiment of the present disclosure.

FIG. 1 is a conceptual diagram for describing a semiconductor circuit according to an embodiment of the present disclosure. Referring to FIG. 1, a semiconductor circuit 1 according to an embodiment of the present disclosure includes a bandgap reference (BGR) voltage generation circuit 10, a first startup (SU1) circuit 20 and a second startup (SU2) circuit 30.

The bandgap reference voltage generation circuit 10 generates a bandgap reference voltage to be provided to other electrical elements. In this embodiment, the bandgap reference voltage generation circuit 10 may provide the generated bandgap reference voltage to other electrical elements via an output voltage node VOUT. Such a bandgap reference voltage generation circuit 10 may be implemented so as to be integrated in an integrated circuit together with other electrical elements.

The bandgap reference voltage generation circuit 10 provides a stable reference voltage to other electrical elements, particularly in spite of a change in operating temperature. However, in an environment in which the power supply voltage is not provided within an appropriate time or the operating temperature is very low, the startup of the bandgap reference voltage generation circuit 10 may not be normally performed. To compensate for this problem, a startup circuit which executes the startup of the bandgap reference voltage generation circuit 10 may be implemented together. In this embodiment, the startup circuit includes the first startup circuit 20 and the second startup circuit 30.

The first startup circuit 20 is connected to an output voltage node VOUT and a node N2 of the bandgap reference voltage generation circuit 10. The first startup circuit 20 receives the output signal of an OP amplifier 12 (FIG. 2) of the bandgap reference voltage generation circuit 10 through the output voltage node VOUT, and pulls up the node N2 of the bandgap reference voltage generation circuit 10. Here, the OP amplifier 12 amplifies the differential voltage between the node N1 and the node N2 to generate the output signal, which will be described later with reference to FIG. 2.

The second startup circuit 30 is connected to the output voltage node VOUT of the bandgap reference voltage generation circuit 10. The second startup circuit 30 pulls down the output voltage node VOUT of the bandgap reference voltage generation circuit 10.

In this embodiment, the first startup circuit 20 and the second startup circuit 30 are represented by separate blocks in order to conceptually distinguish and describe their operations, but they may be implemented as a single circuit or a plurality of circuits.

Figure 2:
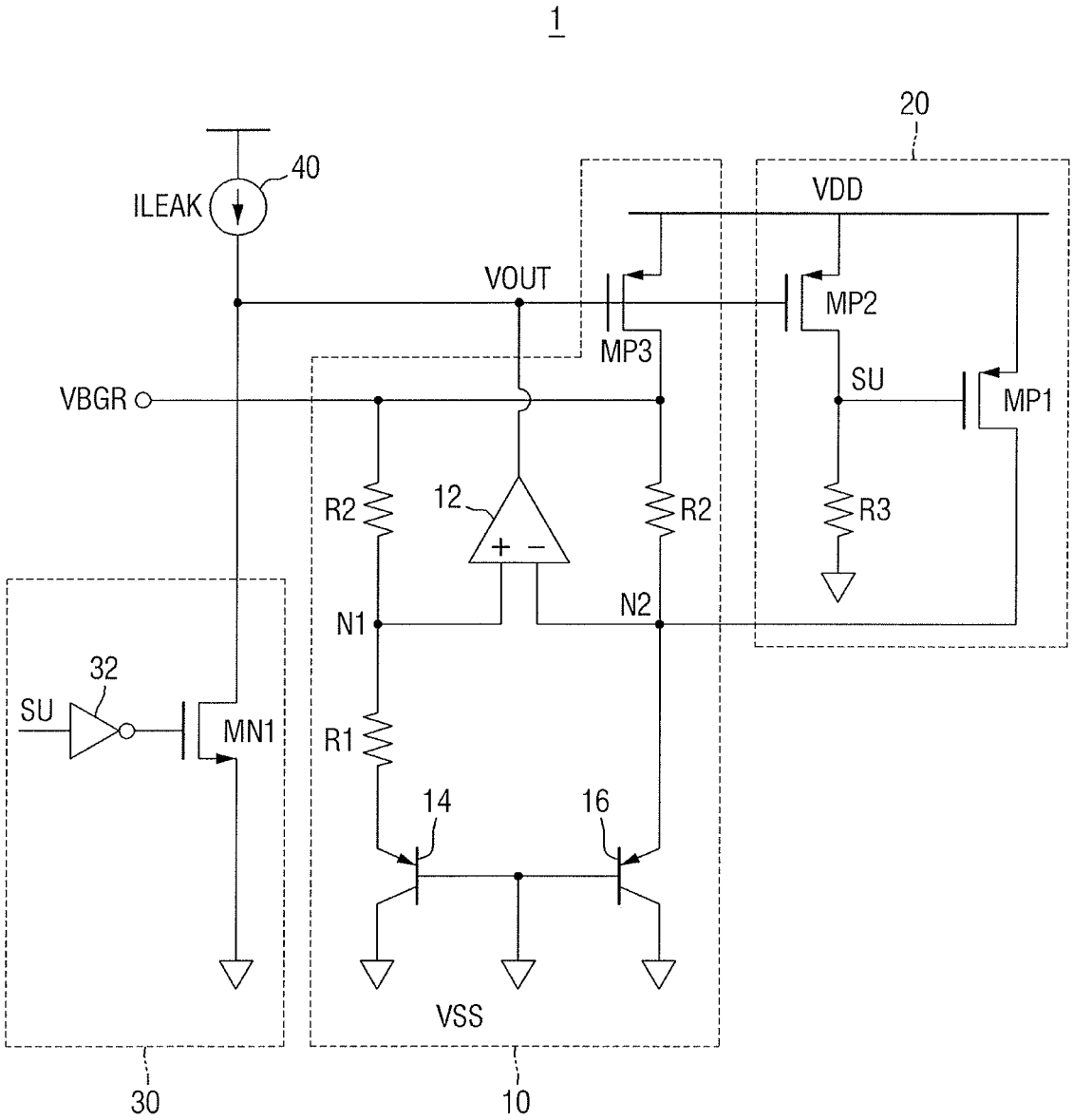
FIG. 2 illustrates a circuit diagram for describing the semiconductor circuit according to an embodiment of the present disclosure.

Now, a specific implementation example of the semiconductor circuit 1 will be described referring to FIG. 2. FIG. 2 is a circuit diagram for describing the semiconductor circuit according to an embodiment of the present disclosure. Referring to FIG. 2, the semiconductor circuit 1 according to an embodiment of the present disclosure includes the bandgap reference voltage generation circuit 10, the first startup circuit 20 and the second startup circuit 30, as described with reference to FIG. 1.

The bandgap reference voltage generation circuit 10 may include the OP amplifier 12, bipolar junction transistors 14 and 16, a first resistor R1, a pair of second resistors R2 and a transistor MP3. The bandgap reference voltage generation circuit 10 is connected between an operating voltage node VBGR to which the operating voltage is provided and a ground voltage VSS.

The bipolar junction transistors 14 and 16 have bases and collectors connected to the ground voltage VSS. The bipolar junction transistor 14 and the bipolar junction transistor 16 may be matched at a ratio of N:1 in accordance with the implementing purpose. For example, the bipolar junction transistor 14 may have a region that is N times larger than the bipolar junction transistor 16.

The first resistor R1 is connected between an emitter of the bipolar junction transistor 14 and the node N1. A first resistor of the pair of second resistors R2 is connected between the operating voltage node VBGR and the node N1, thereby forming a series connection with the first resistor R1. A second resistor of the pair of second resistors R2 is connected between the operating voltage node VBGR and the node N2.

The node N1 provides a non-inverted input to the OP amplifier 12, and the node N2 provides an inverted input to the OP amplifier 12. The node N1 corresponding to the first input of the OP amplifier 10 is between the first resistor of the pair of second resistors R2 and the first resistor R1, and the node N2 corresponding to the second input of the OP amplifier 12 is between the second resistor of the pair of second resistors R2 and the emitter of the junction transistor 16.

The OP amplifier 12 amplifies the differential voltage between the node N1 and the node N2. Further, the OP amplifier 12 outputs its output signal to the node VOUT.

The bandgap reference voltage generation circuit 10 further includes a transistor MP3. The transistor MP3 is gated to, e.g., controlled by, the voltage level of the output voltage node VOUT. When the transistor MP3 is turned on, the power supply voltage VDD may be provided to the driving voltage node VBGR. In this embodiment, the transistor MP3 may be a positive channel metal oxide semiconductor (PMOS) transistor having a drain connected to the driving voltage node VBGR.

The bandgap reference voltage generation circuit 10 may be implemented using alternative circuit configurations. In other words, the bandgap reference voltage generation circuit 10 in which the startup operation is performed by the first startup circuit 20 and the second startup circuit 30 is not limited to a specific circuit configuration, but may be implemented as an arbitrary circuit to generate a bandgap reference voltage as known to one skilled in the art.

The first startup circuit 20 includes a transistor MP1, a transistor MP2 and a third resistor R3. The transistor MP1 is between the power supply voltage VDD and the node N2, and is gated to, e.g., controlled by, the voltage level of the startup node SU. When the transistor MP1 is turned on, the power supply voltage VDD may be provided to the node N2. In this embodiment, the transistor MP1 may be a PMOS having a drain connected to the node N2.

The transistor MP2 is between the power supply voltage VDD and the startup node SU, and is gated to, e.g., controlled by, the voltage level of the output voltage node VOUT. When the transistor MP2 is turned on, the power supply voltage VDD may be provided to the startup node SU. In this embodiment, the transistor MP2 may be a PMOS transistor having a drain connected to the startup node SU.

The third resistor R3 is connected between the startup node SU and the ground voltage VSS.

The second startup circuit 30 includes a transistor MN1. The transistor MN1 is between the output voltage node VOUT and the ground voltage VSS, and is gated to, e.g., controlled by, the inverted voltage level of the startup node SU. An inverter 32 may be included to provide the inverted voltage of the startup node SU to the transistor MN1. When the transistor MN1 is turned on, the ground voltage VSS is provided to the output voltage node VOUT. In this embodiment, the transistor MN1 may be a negative channel metal oxide semiconductor (NMOS) transistor having a drain connected to the output voltage node VOUT.

Figure 3:
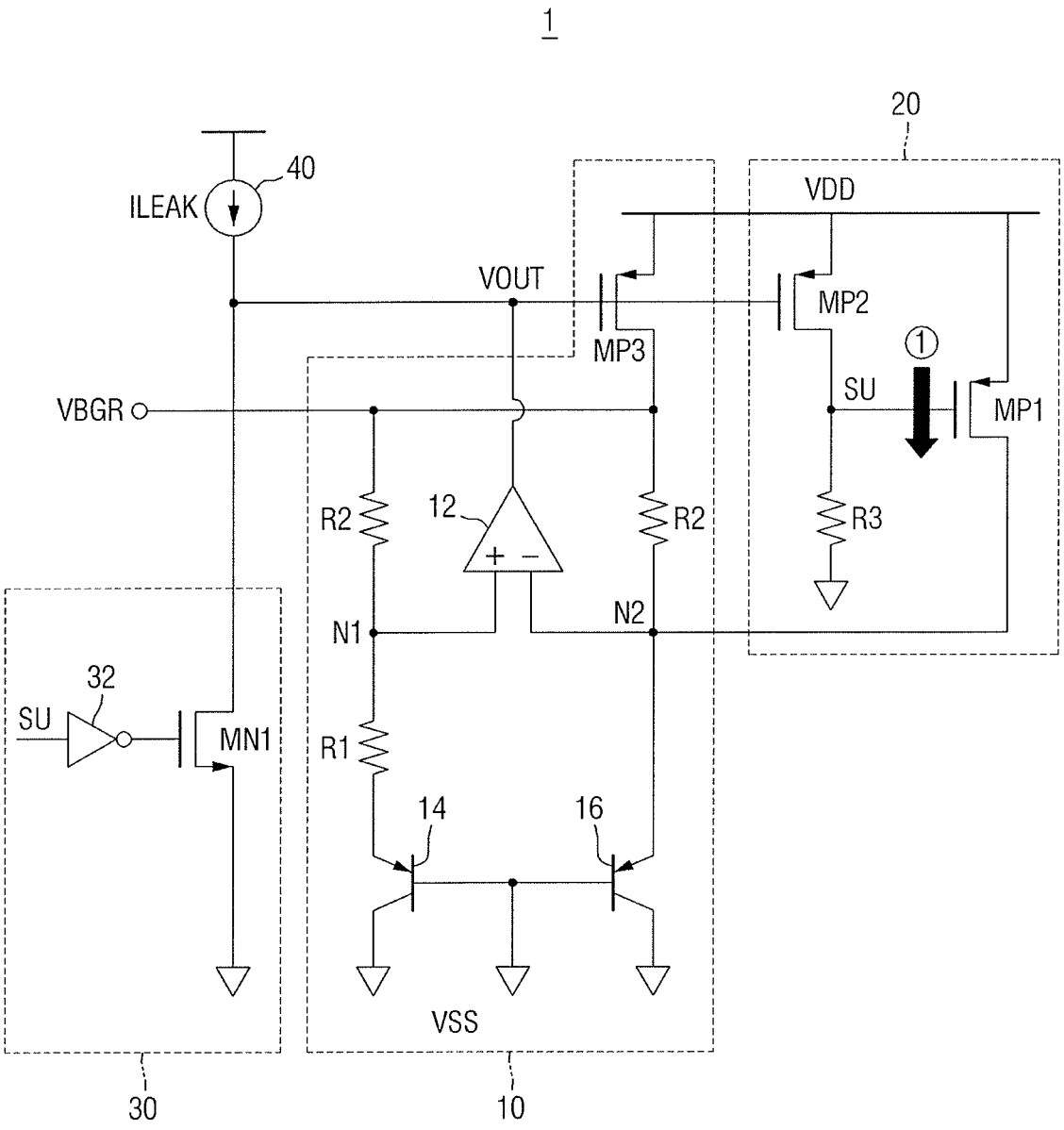
FIGS. 3 to 5 illustrate circuit diagrams for explaining the operation of the semiconductor circuit of FIG. 2.
Figure 4:
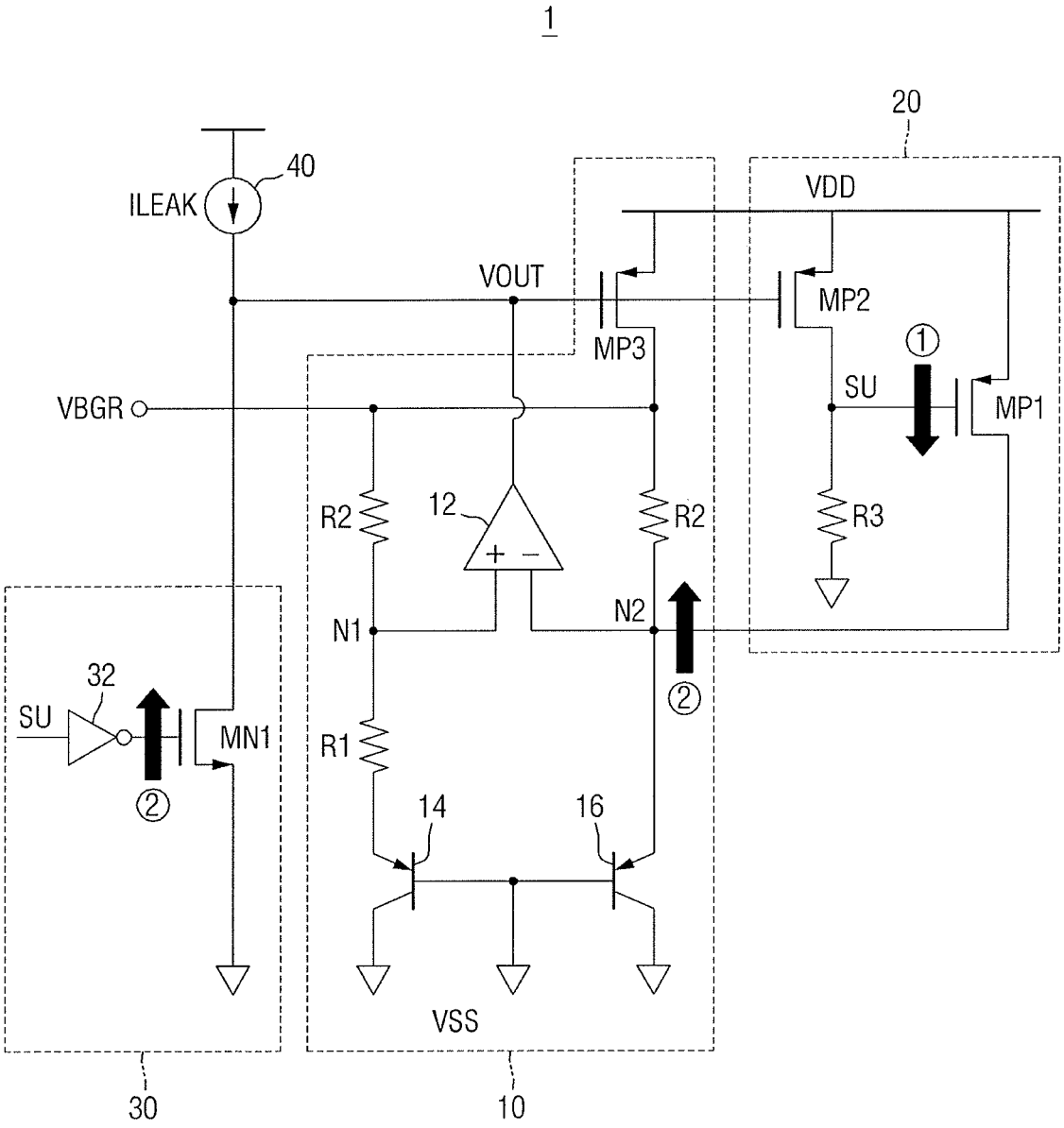
Figure 5:
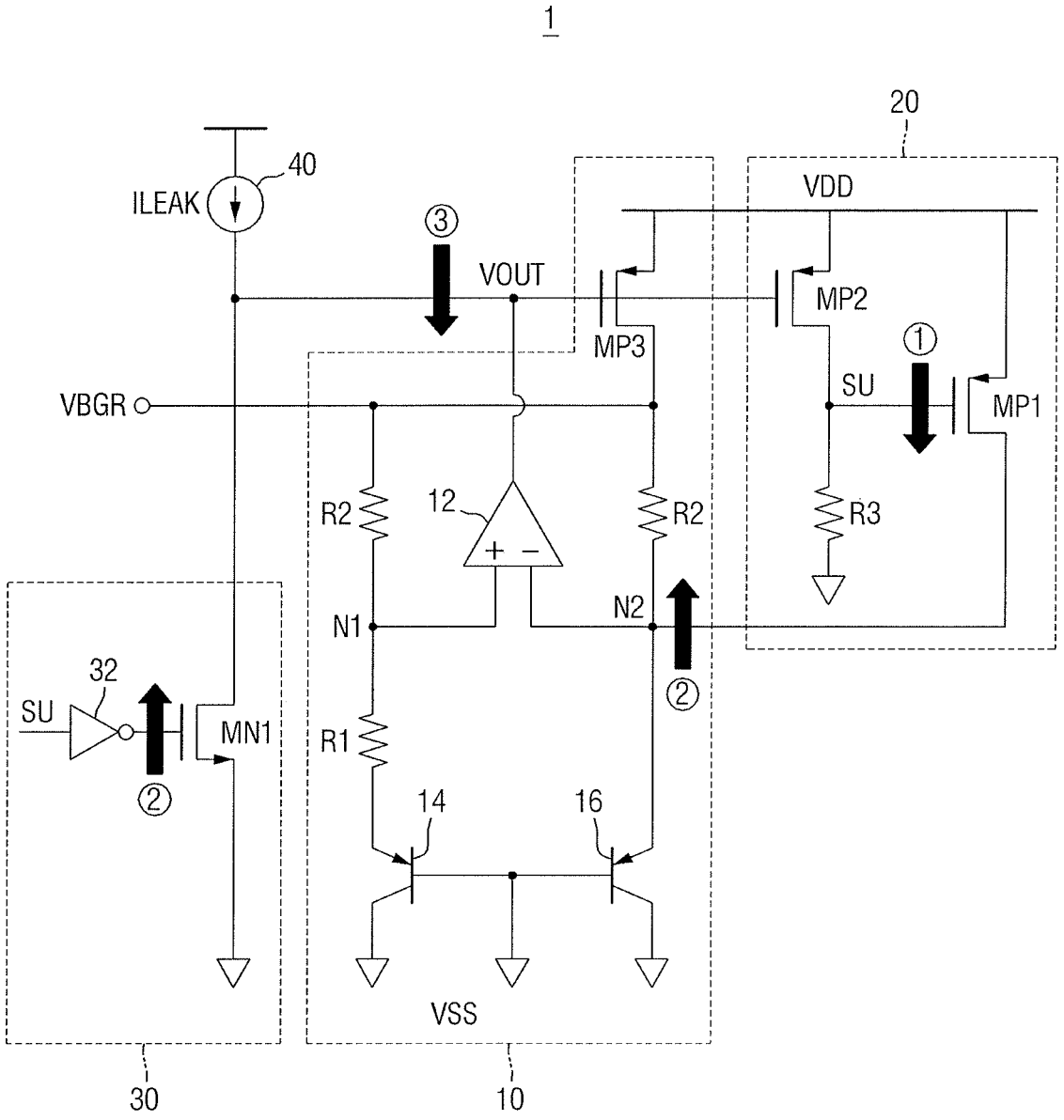

The operation of the semiconductor circuit 1 will now be described with reference to FIGS. 3 to 5. FIGS. 3 to 5 are circuit diagrams for explaining the operation of the semiconductor circuit 1 of FIG. 2.

Referring to FIG. 3, first, the transistor MP2 of the first startup circuit 20 may be turned off at the beginning of driving of the bandgap reference voltage generation circuit 10. When the transistor MP2 is turned off, the transistor MP1 is turned on to provide the power supply voltage VDD to the node N2. That is, the first startup circuit 20 pulls up the node N2 using the transistor MP1 at the beginning of driving of the bandgap reference voltage generation circuit 10. When the node N2 is pulled up, a difference between the node N2 and the node N1 increases, and the OP amplifier 12 amplifies the differential voltage between the node N1 and the node N2, and outputs the output signal thereof to the output voltage node VOUT.

Thereafter, the transistor MP2 is turned on in accordance with the output signal of the output voltage node VOUT. When the transistor MP2 is turned on, the power supply voltage VDD is provided to the startup node SU. Thus, the transistor MP1 is turned off to terminate the operation.

Next, referring to FIG. 4, after the transistor MP1 is turned on, the transistor MN1 of the second startup circuit 30 may be turned on. That is, after the transistor MP1 is turned on and the node N2 is pulled up, the transistor MN1 is turned on to provide the ground voltage VSS to the output voltage node VOUT. That is, after the transistor MP1 is turned on, the second startup circuit 30 pulls down the output voltage node VOUT, using the transistor MN1.

Referring now to FIG. 5, the output voltage node VOUT is pulled down, the transistor MP2 of the first startup circuit 20 is turned on. Thus, the transistor MP1 maintains a turned-off state. In this way, when the startup operation is completed by the first startup circuit 20 and the second startup circuit 30, the bandgap reference voltage generation circuit 10 may generate a stable reference voltage to be provided to other electrical elements.

If the second startup circuit 30 independently performs the startup operation in accordance with the pull-down type, in an environment in which the leakage current of the bandgap reference voltage generation circuit 10 greatly increases the startup operation may fail. For example, when the leakage current ILEAK illustrated in FIGS. 3 to 5 is greater than the strength of the transistor MN1 of the second startup circuit 30, the second startup circuit 30 may not sufficiently generate the input difference between the node N1 and N2 of the OP amplifier 12. This may cause a failure of the bandgap reference voltage generation circuit 10.

In contrast, in this embodiment, before the second startup circuit 30 is driven, the input difference between the nodes N1 and N2 of the OP amplifier 12 is increased in accordance with the pull-up operation of the first startup circuit 20. Then, the output voltage node VOUT corresponding to the output of the OP amplifier 12 is pulled down using the second startup circuit 30.

Thus, by using the first startup circuit 20 of the pull-up type and the second startup circuit 30 of the pull-down type together, in an environment in which the leakage current of the bandgap reference voltage generation circuit 10 greatly increases, normal startup operation may be achieved, while maintaining high-speed ramp-up characteristics.

Figure 6:
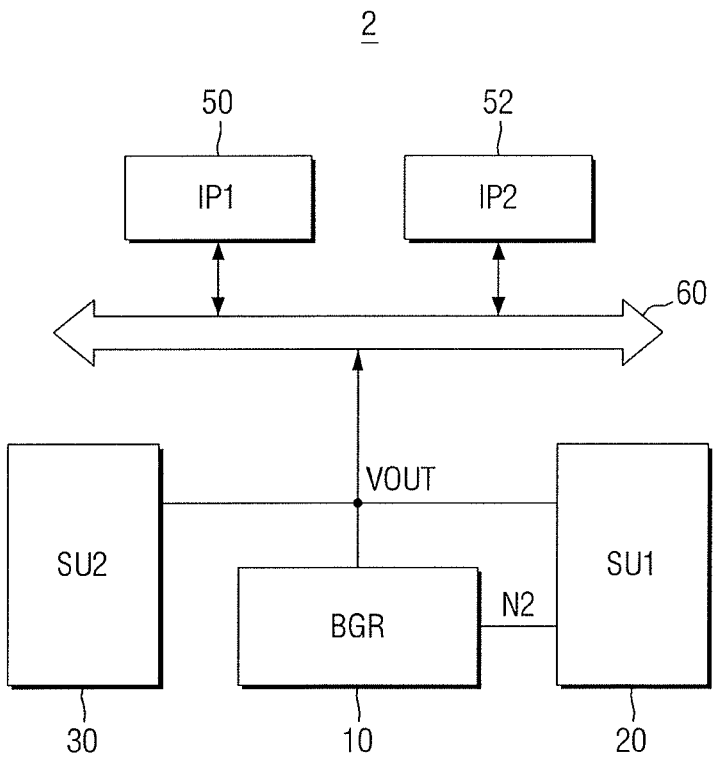
FIG. 6 illustrates a conceptual diagram for explaining the semiconductor system according to an embodiment of the present disclosure.

FIG. 6 is a conceptual diagram for explaining a semiconductor system 2 according to an embodiment of the present disclosure. Referring to FIG. 6, the semiconductor system 2 according to an embodiment of the present disclosure includes the bandgap reference voltage generation circuit 10, the first startup circuit 20, the second startup circuit 30, and one or more IP (Intellectual Property) blocks 50 and 52. The bandgap reference voltage generation circuit 10 may provide a bandgap reference voltage to one or more IP blocks 50 and 52 electrically connected to each other via a bus 60, through an output voltage node VOUT.

In this embodiment, the semiconductor system 2 may be an application processor (AP). Further, one or more IP blocks 50 and 52 may correspond to modules having various functions mounted inside the application processor. It should be noted that the reference voltage generation circuit 10, the first startup circuit 20, and the second startup circuit 30 may also be mounted inside the application processor. After finishing the startup operation by the first startup circuit 20 and the second startup circuit 30, the reference voltage generation circuit 10 may generate a bandgap reference voltage for being provided to one or more IP blocks 50 and 52, and may provide the generated bandgap reference voltage to one or more IP blocks 50 and 52 through the output voltage node VOUT.

The first startup circuit 20, that may prevent the startup of the bandgap reference voltage generation circuit 10 from not being normally performed, is connected to the output voltage node VOUT and the node N2 of the bandgap reference voltage generation circuit 10. The first startup circuit 20 receives the input of the output signal of the OP amplifier 12 inside the bandgap reference voltage generation circuit 10 through the output voltage node VOUT, and pulls up the node N2 of the bandgap reference voltage generation circuit 10.

The second startup circuit 30, that may prevent the startup of the bandgap reference voltage generation circuit 10 from not being normally performed, is connected to the output voltage node VOUT of the bandgap reference voltage generation circuit 10. The second startup circuit 30 pulls down the output voltage node VOUT of the bandgap reference voltage generation circuit 10.

If the second startup circuit 30 independently performs the startup operation in accordance with the pull-down type, in an environment in which the leakage current of the bandgap reference voltage generation circuit 10 greatly increases the startup operation may fail. For example, when the leakage current ILEAK illustrated in FIGS. 3 to 5 is greater than the strength of the transistor MN1 of the second startup circuit 30, the second startup circuit 30 may not sufficiently generate the input difference between the node N1 and N2 of the OP amplifier 12. This may cause a failure of the bandgap reference voltage generation circuit 10.

In contrast, in this embodiment, before the second startup circuit 30 is driven, the input difference between the nodes N1 and N2 of the OP amplifier 12 is increased in accordance with the pull-up operation of the first startup circuit 20. Then, the output voltage node VOUT corresponding to the output of the OP amplifier 12 is pulled down using the second startup circuit 30.

Accordingly, by using the first startup circuit 20 of the pull-up type and the second startup circuit 30 of the pull-down type together, in an environment in which the leakage current of the bandgap reference voltage generation circuit 10 greatly increases, the normal startup operation may be achieved, while maintaining the high-speed ramp-up characteristics. In this embodiment, the first startup circuit 20 and the second startup circuit 30 are represented by separate blocks in order to conceptually distinguish their operations from each other, but they may be implemented as a single circuit or a plurality of circuits.

By way of summation and review, when only a pull-down type startup circuit is used, the startup operation may fail in an environment (e.g., a high-temperature environment) in which a leak current of the bandgap reference voltage generation circuit increases.

In contrast, by using both a pull-up type startup circuit and a pull-down startup circuit, embodiments may provide a semiconductor circuit and system capable of performing a normal startup operation even with high leakage current, while maintaining high-speed ramp-up characteristics.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A semiconductor circuit, comprising:

a bandgap reference voltage generation circuit including an operational amplifier to amplify a differential voltage between a first node and a second node;

a first startup circuit which receives input of an output signal of the operational amplifier from an output voltage node of the bandgap reference voltage generation circuit and pulls up the second node; and a second startup circuit which pulls down the output voltage node, wherein the second startup circuit includes a transistor controlled by an inverted voltage level of a startup node, and a ground voltage is provided to the output voltage node when the transistor is turned on.

2. The semiconductor circuit as claimed in claim 1, wherein:

the first startup circuit includes a first transistor controlled by a voltage level of the startup node, and a power supply voltage is provided to the second node when the first transistor is turned on.

3. The semiconductor circuit as claimed in claim 2, wherein the first transistor is a PMOS transistor, and a drain of the first transistor is connected to the second node.

4. The semiconductor circuit as claimed in claim 2, wherein:

the first startup circuit further includes a second transistor controlled by a voltage level of the output voltage node, and the power supply voltage is supplied to the startup node when the second transistor is turned on.

5. The semiconductor circuit as claimed in claim 4, wherein the second transistor is a PMOS transistor, and a drain of the second transistor is connected to the startup node.

6. The semiconductor circuit as claimed in claim 4, wherein:

when the second transistor is turned off, the first transistor is turned on to provide the power supply voltage to the second node, the second transistor is turned on in accordance with an output signal which is output to the output voltage node by amplifying the differential voltage between the first node and the second node through the operational amplifier, and as the second transistor is turned on, the first transistor is turned off.

7. The semiconductor circuit as claimed in claim 1, wherein the transistor is an NMOS transistor, and a drain of the transistor is connected to the output voltage node.

8. The semiconductor circuit as claimed in claim 1, wherein the bandgap reference voltage generation circuit further includes a fourth transistor controlled by a voltage level of the output voltage node and having a drain connected to a driving voltage.

9. A semiconductor circuit, comprising:

a bandgap reference voltage generation circuit which includes an operational amplifier to amplify a differential voltage between a first node and a second node;

a first startup circuit which includes a first transistor, controlled by a voltage level of a startup node to provide a power supply voltage to the second node, and a second transistor, controlled by a voltage level of an output voltage node of the bandgap reference voltage generation circuit to provide the power supply voltage to the startup node; and a second startup circuit which includes a third transistor controlled by an inverted voltage level of the startup node to provide a ground voltage to the output voltage node.

10. The semiconductor circuit as claimed in claim 9, wherein the first startup circuit pulls up the second node.

11. The semiconductor circuit as claimed in claim 9, wherein the second startup circuit pulls down up the output voltage node.

12. The semiconductor circuit as claimed in claim 9, wherein the first transistor is a PMOS transistor, and a drain of the first transistor is connected to the second node.

13. The semiconductor circuit as claimed in claim 9, wherein the second transistor is a PMOS transistor, and a drain of the second transistor is connected to the startup node.

14. The semiconductor circuit as claimed in claim 9, wherein the third transistor is an NMOS transistor, and a drain of the third transistor is connected to the output voltage node.

15. A semiconductor system, comprising:

a bandgap reference voltage generation circuit including an operational amplifier to amplify a differential voltage between a first node and a second node;

a first startup circuit which receives input of an output signal of the operational amplifier from an output voltage node of the bandgap reference voltage generation circuit and pulls up the second node;

a second startup circuit which pulls down the output voltage node, wherein the second startup circuit includes a transistor controlled by an inverted voltage level of a startup node, and a ground voltage is provided to the output voltage node when the transistor is turned on; and one or more loads driven using a voltage provided through the output voltage node.

16. The semiconductor system as claimed in claim 15, wherein:

the first startup circuit includes a first transistor controlled by a voltage level of the startup node, and a power supply voltage is provided to the second node when the first transistor is turned on.

17. The semiconductor system as claimed in claim 16, wherein:

the first startup circuit further includes a second transistor controlled by to a voltage level of the output voltage node, and the power supply voltage is provided to the startup node when the second transistor is turned on.

* * * * *